US011673290B2

(12) United States Patent
Nicoletti

(10) Patent No.: US 11,673,290 B2
(45) Date of Patent: Jun. 13, 2023

(54) SAWING MACHINE

(71) Applicant: MEC S.R.L., Scurelle (IT)

(72) Inventor: Laura Nicoletti, Scurelle (IT)

(73) Assignee: MEC S.R.L., Scurelle (IT)

( * ) Notice: Subject to any disclaimer, the term of this patent is extended or adjusted under 35 U.S.C. 154(b) by 849 days.

(21) Appl. No.: 16/342,967

(22) PCT Filed: May 17, 2018

(86) PCT No.: PCT/IB2018/053453

§ 371 (c)(1),
(2) Date: Apr. 17, 2019

(87) PCT Pub. No.: WO2019/220181

PCT Pub. Date: Nov. 21, 2019

(65) Prior Publication Data

US 2020/0269469 A1 Aug. 27, 2020

(51) Int. Cl.
*B28D 1/04* (2006.01)
*B28D 7/04* (2006.01)

(52) U.S. Cl.
CPC ..... *B28D 1/046* (2013.01); *B28D 7/04* (2013.01)

(58) Field of Classification Search
CPC . B28D 1/00; B28D 1/046; B28D 7/04; B65G 17/065; B65G 17/067; B65G 17/10
See application file for complete search history.

(56) References Cited

U.S. PATENT DOCUMENTS 4,004,748 A 8/1977 Veillaneuva
6,186,314 B1 * 2/2001 Conklin, Jr. ..... B65G 17/067 198/502.1
6,216,848 B1 * 4/2001 Zens ..... B65H 11/005 198/689.1
2001/0052451 A1 * 12/2001 Ruoss ..... B65G 17/34 198/853
2003/0172916 A1 * 9/2003 Buechel ..... B23D 47/045 125/13.01
2017/0305035 A1 * 10/2017 Toncelli ..... B28D 1/044

FOREIGN PATENT DOCUMENTS

FR 1084967 A * 8/1950

OTHER PUBLICATIONS

FR1084967A—Machine Translation (Year: 1950).*

* cited by examiner

*Primary Examiner* — Monica S Carter
*Assistant Examiner* — Alberto Saenz
(74) *Attorney, Agent, or Firm* — Law Office of John K. Pike, PLLC

(57) ABSTRACT

The present invention relates to an automatic sawing machine for cutting blocks of natural and/or concrete stone material, which comprises a single motorized conveyor belt having a conveyor plane for transporting the material to be cut and a driving wall placed substantially at 90° with respect to said conveyor plane so that all together contribute to give the conveyor belt a substantially "L"-shape. The machine comprises a support fixed to the machine and a rotatable crown element placed at the top of said support, provided of a plurality of protuberances spaced apart from each other so as to allow each of said protuberances to be inserted in turn into one of said slot obtained in one of said second portions of said strips, following the movement of the conveyor belt. Methods of cutting blocks of natural and/or concrete stone material with the automatic sawing machine are also provided.

12 Claims, 13 Drawing Sheets

SAWING MACHINE

CROSS REFERENCE TO RELATED APPLICATIONS

This application is a 371 National Stage Entry of PCT/IB2018/053453 filed May 17, 2018. The contents of PCT/IB2018/053453 filed May 17, 2018 are incorporated by reference in its entirety.

FIELD OF THE INVENTION

The present invention refers to an automatic sawing machine for cutting irregularly shaped and variable-sized materials. Particularly, the present invention refers to a sawing machine for cutting blocks of marble, porphyry, granite and similar materials, of irregular shape and of variable dimensions.

STATE OF THE ART

Automatic sawing machines are known for cutting blocks of stone, marble, granite and similar stone materials, or of concrete shapes made with special cement moulds, in order to realize surface coating elements.

Typically, such sawing machines comprise at least one longitudinally extending conveyor belt and defines a cutting path along which a plurality of cutting devices are arranged in succession. The cutting devices are for example constituted by a motor, for example an electric motor, on whose axis a circular blade is keyed, typically a diamond disk. The circular blades are aligned with respect to the cutting path in order to define a line for cutting the blocks. An example of an automatic sawing machine of this type is disclosed by the patent application published as EP 1103359 A1.

Also automatic sawing machines comprising at least two conveyor belts arranged at right angles one each other and inclined with respect to a horizontal plane so as to define a channel for receiving the blocks to be cut are known.

For example, the Italian patent published with n. IT1414822 discloses an automatic sawing machine for cutting stones and similar materials which has a third longitudinal transport element, associated with at least one pressure belt, placed laterally to the diamond cutting disks and which is opposed to two longitudinal transport elements.

The American U.S. Pat. Nos. 7,771,249 and 8,100,740 disclose a sawing machine provided with two conveyor belts, each disposed at about 45° with respect to the ground so as to form a V-shaped channel between them.

However, such automatic sawing machines provided with at least two conveyor belts need to synchronize the conveyor belt movements, often having to reduce the transporting speed at the same time, as well as they need greater maintenance.

The Applicant of the present patent application has found the need to realize a sawing machine which allows to overcome the aforementioned drawbacks, so that the material to be treated can be correctly loaded and positioned, and that the machine is able to continuously work, without ever stopping.

SUMMARY OF THE INVENTION

According to a first aspect, the present invention relates to a sawing machine as the one of claim 1.

The present invention arises from the general consideration according to which the above-mentioned technical problem can be effectively and reliably solved by means of an automatic sawing machine for cutting blocks of natural and/or concrete stone, wherein said sawing machine comprises a single motorized conveyor belt, defining a cutting path adapted to receive in succession said blocks of material to be cut and to transport them from a first inlet station to a second outlet station, and wherein said sawing machine further comprises a plurality of cutting devices each of them being provided with a motor 8*a* on whose axis a circular blade is keyed, said cutting devices being constrained to said sawing machine and being disposed above the cutting path defined by the conveyor belt with respect to a vertical direction in such a way the respective circular blades are within the cutting path itself;

characterized in that said single motorized conveyor belt consists of a conveyor plane for transporting the material to be cut and a driving wall placed substantially at 90° with respect to said conveyor plane so that the conveyor plane and the driving wall all together contribute to give the single conveyor belt a substantially "L"-shape.

In this way, the sawing machine of the present invention is made with a single conveyor belt, avoiding the need to synchronize the movement of two or more belts advancing simultaneously, also reducing maintenance times and costs, and at the same time obtaining also a greater transportation speed.

Moreover, the single conveyor belt thus produced is provided with a driving wall, or abutment plane, which serves to facilitate the transportation of the material to be cut, as well as to determine the finished product thickness.

According to a preferred embodiment, said single L-shaped conveyor belt is constituted by a series of modular strips arranged adjacent one to the other, wherein each of said modular strips is a single element having itself an L-shape constituted by a first portion and a second portion placed substantially at 90° with respect to said first portion and wherein the series of said first portions of the strips, side by side, constitute said conveyor plane, and wherein the series of said second portions of the strips, placed side by side, constitute said driving wall.

In this way, the presence of the modular strips placed adjacent one each other allows to lengthen and/or shorten the single conveyor belt according to the customer needs, respectively adding and/or removing an appropriate number of strips.

According to a preferred embodiment, said single L-shaped conveyor belt is arranged at an angle of from about 10° to about 40°, preferably from about 15° to about 30°, with respect to the ground.

According to a preferred embodiment, said L-shaped strips are fixed by means of screws to a chain that slides on a modular carpentry, wherein each carpentry module is fixed to an adjacent module by plates and counter-plates screwed one each other.

In this way, the machine can easily be dismantled and reassembled to optimize transport costs.

According to a preferred embodiment, said conveyor belt is provided with covering device such as a crankcase-type arranged at said first inlet station and at said second outlet station, to protect said second portions of the strips, in correspondence of the change of direction of the conveyor belt.

In this way, the presence of the crankcase-type to protect the strips during the belt rotation provides the necessary security.

According to a preferred embodiment, each of said second portions of said strips is provided with an opening, such as a slot.

In this way, each of said second portions of said strips is provided with an opening through which tools or various useful elements may pass over.

According to a preferred embodiment, the automatic sawing machine of the present invention further comprises a device consisting of a support fixed to the machine and of a crown-like element, placed at the top of said support, provided with a plurality of protuberances spaced from each other and able to rotate about a vertical axis, substantially perpendicular to the conveyor belt direction.

In this way, each of said protuberances of the crown device is able to be inserted, in turn, following the conveyor belt movement, into one of said openings obtained in the second portions of the strips.

This allows these protuberances to pass through the openings and to reach and hit the worked stones or other similar material during transport on the conveyor belt.

According to a preferred embodiment, the distance between one protuberance and the other one of the crown device is in line with the distance between the opening of a strip and the opening of the adjacent strip.

A continuous action is thus generated by a first protuberance of the crown passing through the opening of a strip, followed by the similar action of the successive protuberance of the crown passing through the opening of the adjacent strip and so on, until all the protuberances of the crown are passed in turn through the opening of a strip, to start a new cycle with the new passage of the first protuberance in a new opening of a strip.

In this way, the stones that are passing in correspondence of said crown are thus moved of few millimetres, sufficient to prevent them from colliding and getting caught against the crankcase at the outlet station of the sawing machine. This avoids prolonged damage to the crankcase and stops the machine to free the stones entangled in the crankcase.

According to a preferred embodiment, the automatic sawing machine of the present invention further comprises guides removably fixed to said second portions of said strips to facilitate insertion/removal of said circular blades of suitable diameter according to the needs.

In this way, it is possible to assemble cutting devices provided with blades having different diameters on the same shaft, exploiting to the utmost the use on the same shaft of large and small disks depending on the needs, and minimizing the times for disk installation and replacement.

In one embodiment it is therefore possible to mount on each of the shafts, for example on the very last one shaft, i.e. the one closest to the outlet station of the sawing machine, a disk with an external diameter of 600 mm (for cutting to 0) or a disk with diameter up to 1200 mm (to cut stones up to 45 cm high).

In this way, the disk consumption is optimized to the maximum as, if it is required to cut low-level materials, small-diameter disks will be mounted and, as a result, higher speeds and greater productivity can be used. Conversely, if high stones (up to 45 cm) are requested to be cut, larger diameter disks will be used.

According to a preferred embodiment, the positioning of said circular blades is adjustable according to the required cut depth.

In this way, depending on the needs, it is possible to have different ways of producing the finished product.

For example, in an embodiment, when it is required that the finished product present "witnesses", i.e. the presence of a slight thickness around the cut stone for a better installation, the cutting depth of the circular blades will be chosen in a range from about 5 to about 10 mm.

On the other hand, when the presence of such "witnesses" is not required, i.e. when a stone with a completely sawn surface is required, the cutting depth of the circular blades will be chosen around about −1 mm.

According to a preferred embodiment, said conveyor plane of the conveyor belt is coated with a protective mat, such as made in rubber.

In this way, the conveyor plane is protected from possible incisions of too deep circular blades.

In this embodiment, wherein the protective mat covering the conveyor belt is present, the sawing machine of the present invention to further comprises a series of rollers which determine a V-shaped path in order to realize the proper tensioning of said conveyor plane of the conveyor belt.

According to another preferred embodiment, each of said first portions of said strips constituting the conveyor plane of the conveyor belt is coated with a protective material, such as made in rubber.

In this way, each single strip is rubberized and therefore protected from possible incisions of the too deep circular blades.

According to a preferred embodiment, the sawing machine of the present invention is further provided with a wedge-shaped device, placed thereafter to said crown, in the direction towards said outlet station.

In this way, the spacing of the stones from the shoulder of the portions of the strips is further encouraged.

According to a preferred embodiment, said cutting device is also provided with a device that allows the cutting disk rotation, where the rotation axis is longitudinal with respect to the conveyor belt, so that the cutting device head is able to assume a tilted position with respect to the transporting direction of the material to be cut.

In this way, the advantage that the cutting blade is not necessarily perpendicular to the conveyor belt is obtained; in fact, the angle of the cutting element is adjusted according to the processing desired by the operator.

BRIEF DESCRIPTION OF THE DRAWINGS

Further characteristics and advantages of the present invention will be better highlighted by examining the following detailed description of a preferred but not exclusive embodiment, illustrated by way of non-limiting example, with the support of the attached drawings, wherein.

DETAILED DESCRIPTION

With reference to FIGS. 1-7, a first embodiment of a sawing machine 1 according to the present invention is shown below.

Figure 1:
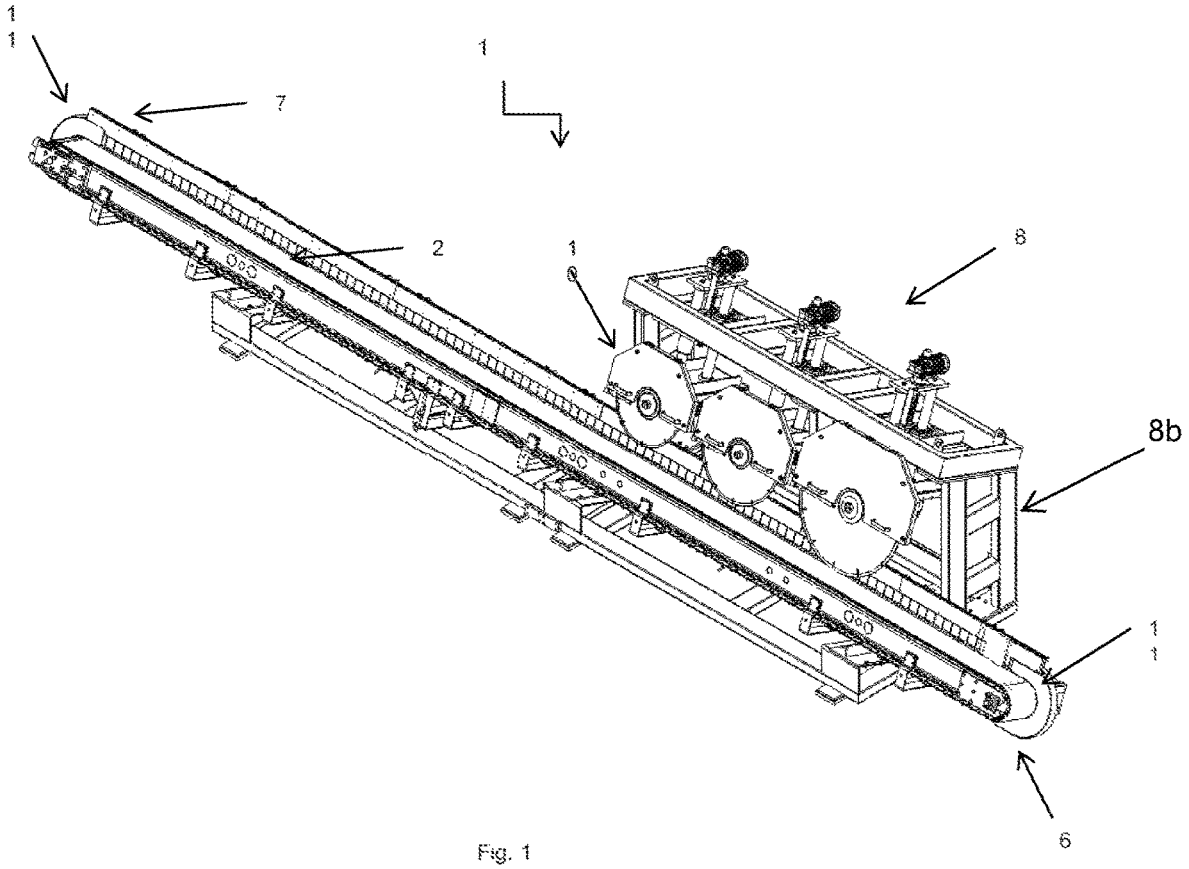
FIG. 1 is a front view of an embodiment of a sawing machine according to the present invention.

FIG. 1 shows an overall view of an automatic sawing machine 1 for cutting blocks of natural and/or concrete stone material, where a single motorized conveyor belt 2 is visible, which receives the material to be cut and carries it from a first inlet station 7 to a second outlet station 6, along which some cutting devices 8 are arranged, each of them is provided with a motor 8*a* (See FIG. 11) on whose axis a circular blade 10 is keyed. Cutting devices 8 are arranged above the cutting path defined by the conveyor belt 2 relative to a vertical direction so that the respective circular blades 10 are within the cutting path itself.

Figure 2:
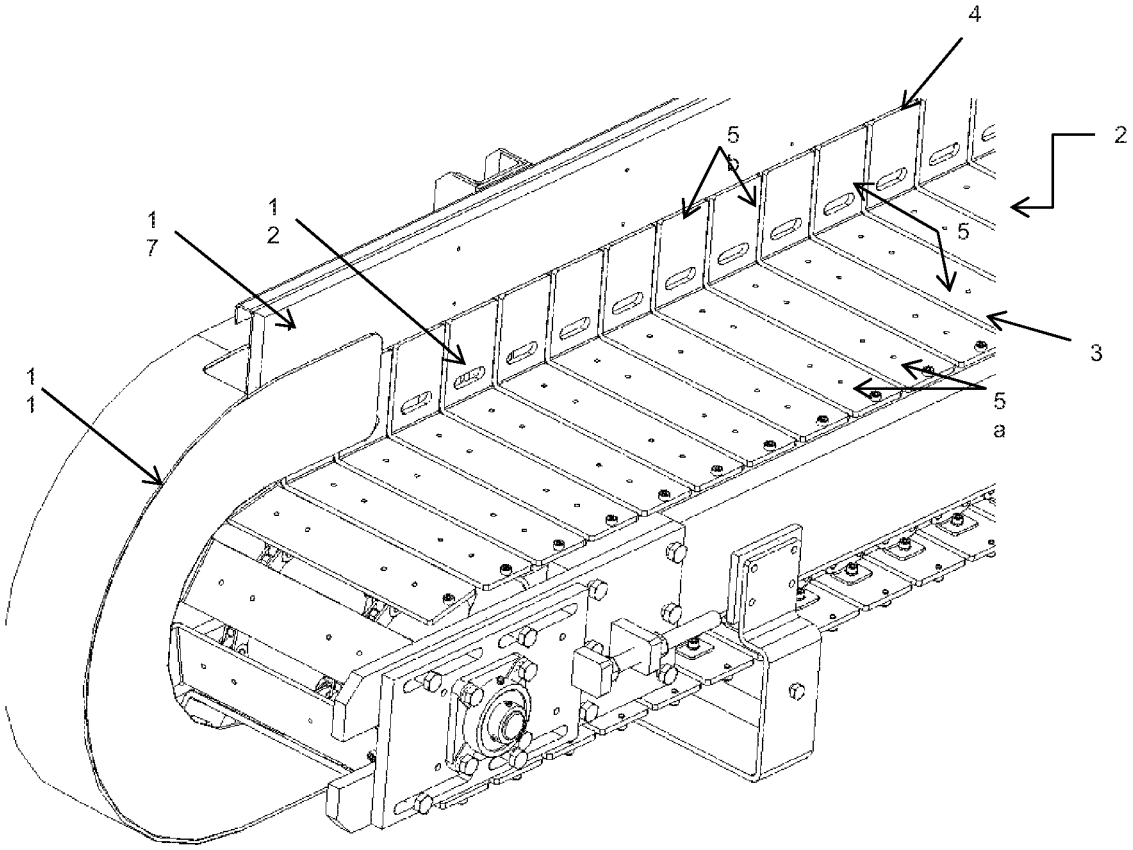
FIG. 2 is a detail of FIG. 1, wherein the conveyor belt is shown at the outlet station of the sawing machine.

As best shown in FIG. 2, the single conveyor belt 2 is L-shaped, consisting of a conveyor plane 3 of the material to be cut and a driving wall 4. The single L-shaped conveyor belt 2 consists of a series of modular strips 5 (detailed in FIG. 3), placed one adjacent to the other, wherein each of said strips 5 is a single element, also L-shaped, consisting of a first portion 5*a* and a second portion 5*b*. The series of the first portions 5*a* of the strips 5, side by side, contribute to form the conveyor plane 3, while the series of the second portions 5*b* of the strips 5, side by side, contribute to form the driving wall 4, which acts as a guide for guiding the stones transported during their transport on the conveyor plane 3. Each of the second portions 5*b* of the strips 5 is provided with an opening, such as slot 12.

The single conveyor belt is placed at an angle of about 20° to the ground.

For safety reasons, at the first inlet station 7 and at the second outlet station 6 of the sawing machine 1, the conveyor belt 2 is provided with a corresponding covering device 11, such as a crankcase, arranged to protect the second portions 5*b* of the strips 5, in correspondence with the change of direction of the conveyor belt 2.

The automatic sawing machine 1 is also provided with a device consisting of a support 14 fixed to the machine (shown in FIG. 4 and in detail in FIG. 5), at the top of which there is a crown-type rotatable element 15, provided with a plurality of protrusions 16 spaced apart one each other in such a way as to allow each of them to engage, in turn, in one of the slots 12 formed in one of the second portions 5*b* of the strips 5, following the movement of the conveyor belt 2. The distance between two adjacent protrusions 16 of the crown 15 and the distance between a slot 12 of a strip 5 and the slot 12 of the adjacent strip 5 is such that, during the movement of the conveyor belt 2, a continuous action is generated between the crown 15 and the slots 12. In practice, during the movement of the conveyor belt 2, a first protrusion 16 of the crown 15 passes through the slot 12 of a strip 5, followed by the similar action of the successive protuberance 16 of the crown 15 passing through the slot 12 of the adjacent strip 5 and so on, until all the projections 16 of the crown 15 are passed in turn through the slot 12 of adjacent strips 5, to restart a new cycle with the new passage of the first protuberance 16 in a slot 12 of a new strip 5.

This allows such projections 16 of the crown 15 to pass through the slot 12 of the portion 5*b* of the strip 5 and to reach and hit the worked stones or other similar material being transported onto the conveyor plane 3.

In this way, the stones which are passing in correspondence with the crown 15 are thus laterally moved ahead of few millimetres, sufficient to prevent them from colliding and getting caught against the crankcase 11 at the outlet station 6 of the sawing machine 1. Prolonged damage to the crankcase 11 and stop the machine to free the stones entangled in the crankcase 11 itself are thus avoided.

Figure 6A:
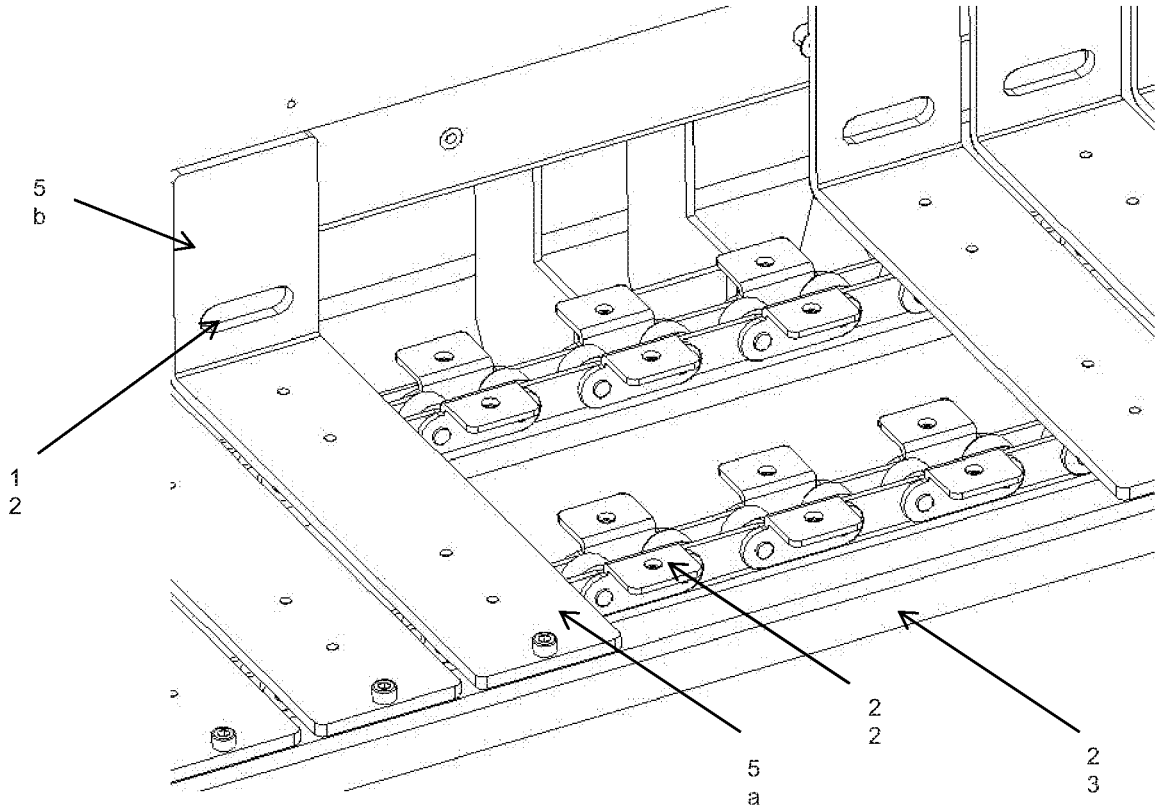
FIG. 6*a* shows a detail of the fixing of the strips to a chain running on a modular carpentry.
Figure 6B:
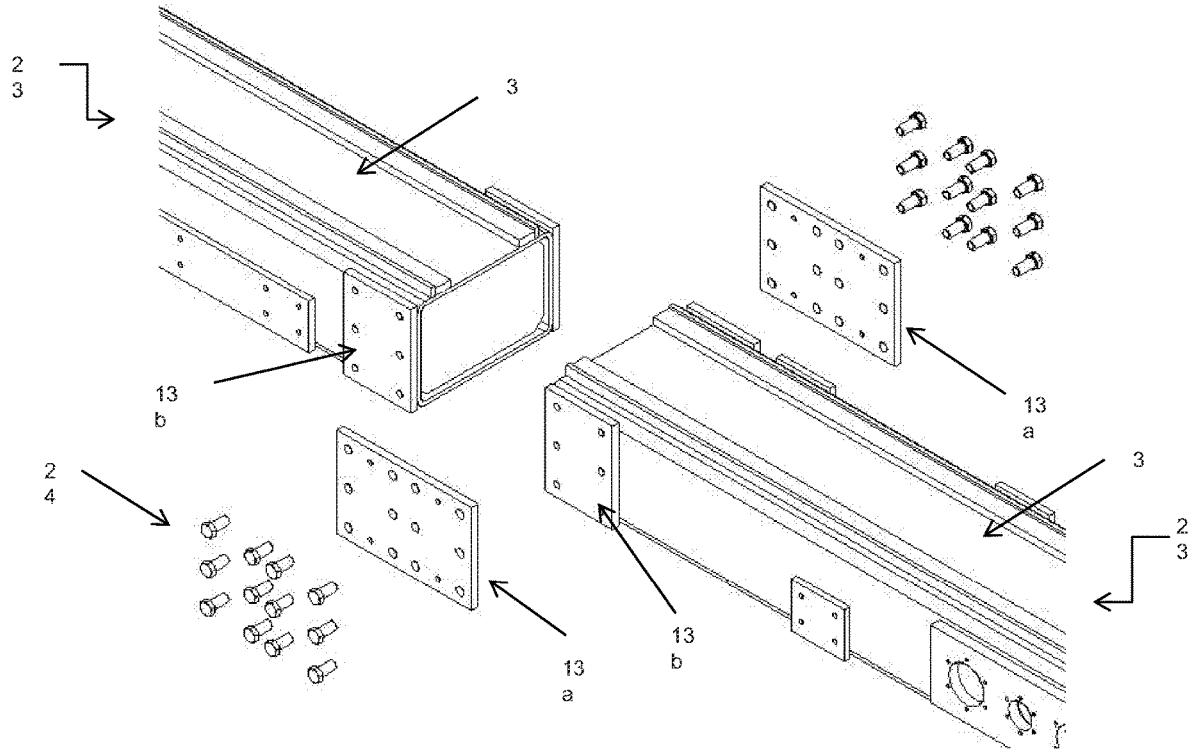
FIG. 6*b* shows a series of plates and counter-plates which fix one each other two carpentry modules of FIG. 6*a;*

The modular L-shaped strips 5 are fixed to the sawing machine 1 in a removable manner. In particular, the strips 5 are fixed by means of screws on the transport chains 22 (FIG. 6*a*) which rotate on a structure, such as a modular carpentry 23. Each carpentry module 23 is fixed to an adjacent module by means of plates 13*a* and counter-plates 13*b* screwed to each other by screws 24 (FIG. 6*b*). In this way, it is possible to choose the length of the single most suitable conveyor belt 2 according to the momentary needs, by adding or removing the appropriate number of strips 5, after having momentarily removed the plates 13*a* and counter-plates 13*b*.

Figure 7:
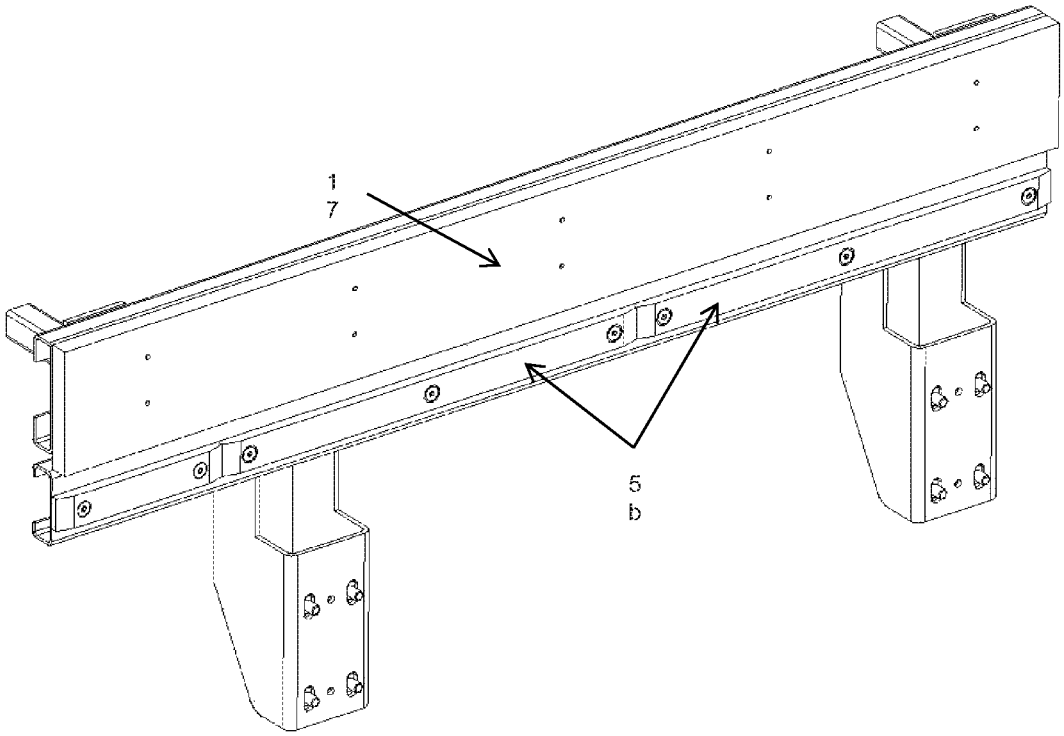
FIG. 7 shows a detail of the guides for obtaining the space required for using disks of different diameters on the same shaft.

As shown in detail in FIG. 7, the automatic sawing machine 1 of the present invention comprises guides 17 fixed removably to the second portions 5*b* of the strips 5 to facilitate the insertion/removal of the circular blades 10 of the cutting device 8. In particular, when there is the need to cut stones up to 45 cm high and large diameter disks, the presence of the guides 17 allows to raise the support surface above the strip 5*b*. Vice versa, in the absence of such guides, the strip 5*b* has its own height and it is possible to mount small disks for cutting 0 of low stones. Thanks to these guides 17, it is therefore possible to replace a circular blade 10 with a more suitable diameter, according to the requirements of different heights in the cutting of the stones or similar material to be cut. Blades with different diameters are used to increase productivity and decrease the disk consumption.

Figure 8:
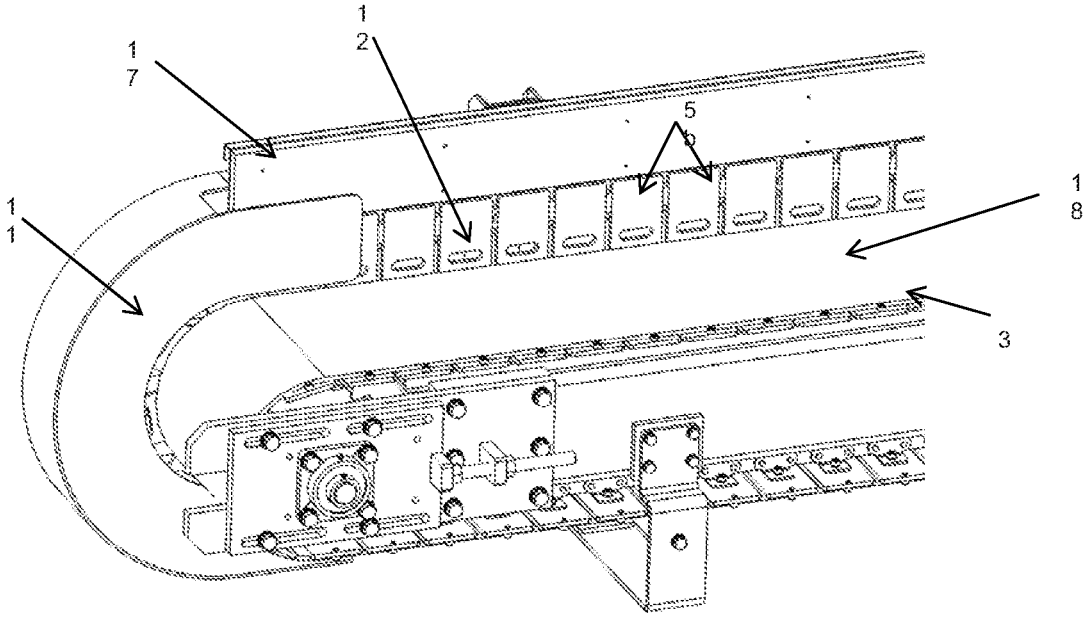
FIG. 8 is a front view of another embodiment of a sawing machine according to the present invention, wherein the conveyor belt is covered by a mat.

FIG. 8 shows a second embodiment of the sawing machine 1 of the present invention, wherein the conveyor plane 3 of the conveyor belt 2 is entirely covered with a mat 18 of protective material, such as rubber. This mat 18 protects the first portions 5*a* (not shown in FIG. 8 because covered by the mat 18) of the strips 5 from any incisions caused by a circular blade when a precise cut of the stone is required, i.e. without "witnesses".

Figure 9:
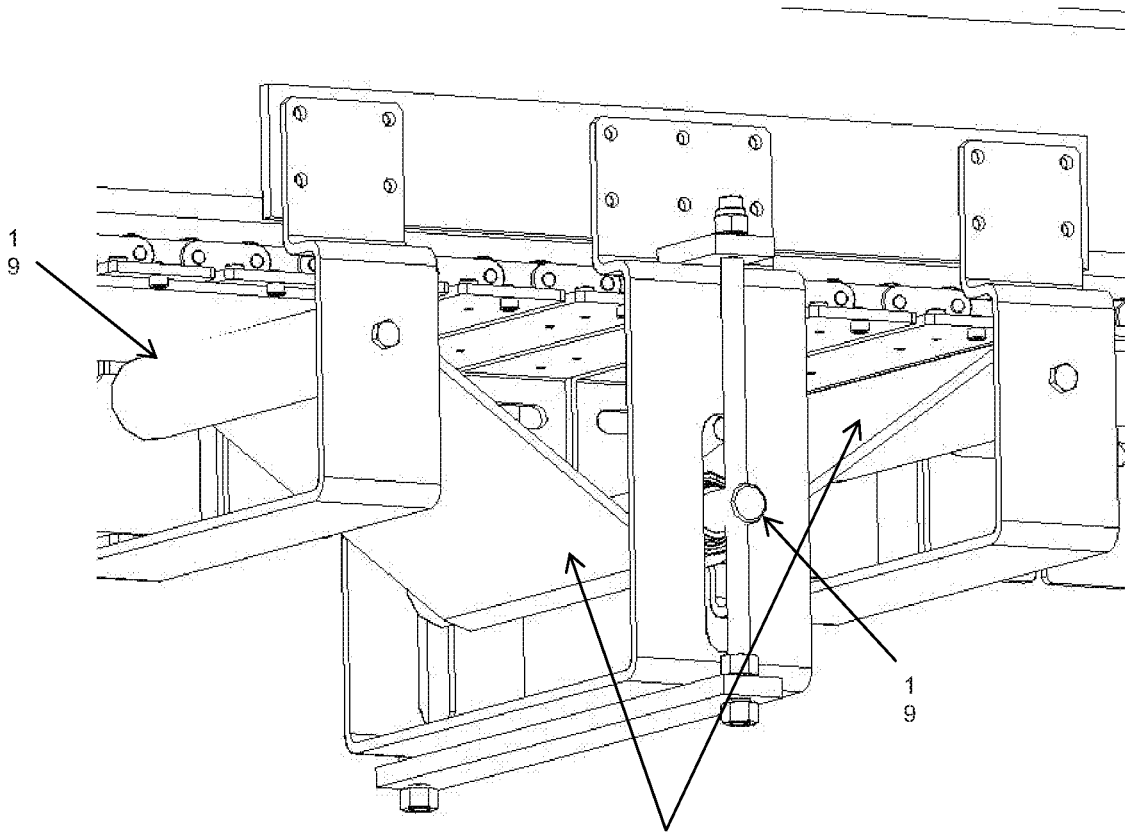
FIG. 9 shows a belt tensioning system covered by a mat of FIG. 8.

In this second embodiment, where the presence of the protective mat 18 is required, the automatic sawing machine 1 is provided with a tensioning system of the conveyor belt 2 shown in FIG. 9, which comprises a series of rollers 19 which determine a path at V-shape 20.

Figure 3A:
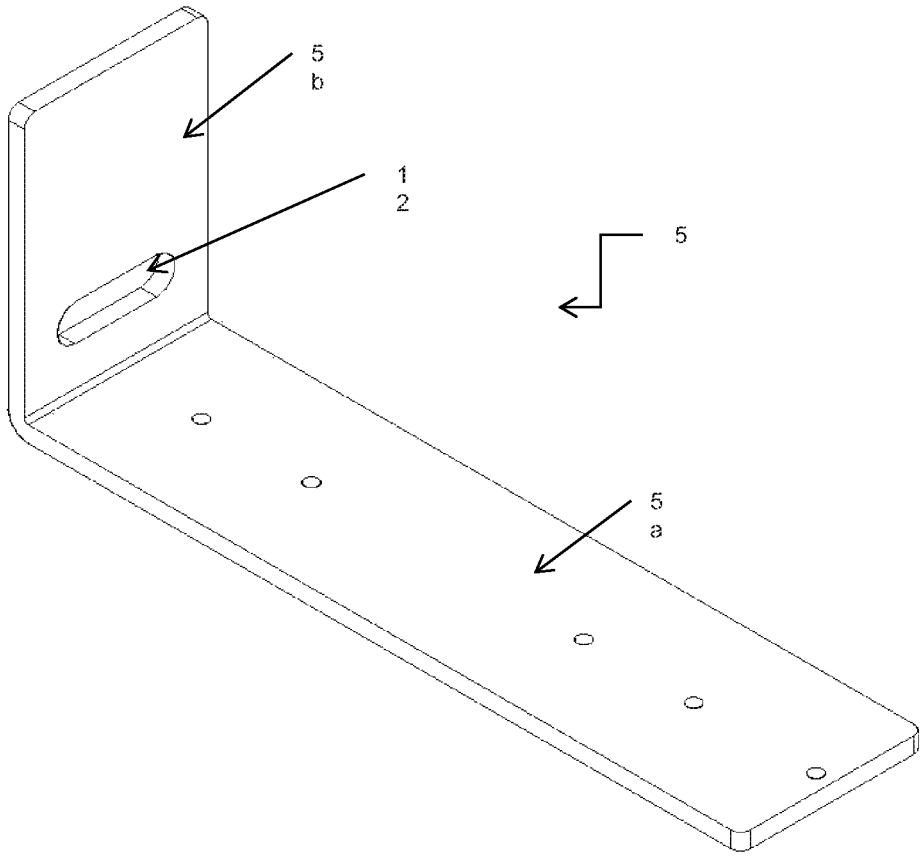
FIG. 3*a* is a detail of FIG. 2, wherein a strip of the conveyor belt is shown.
Figure 3B:
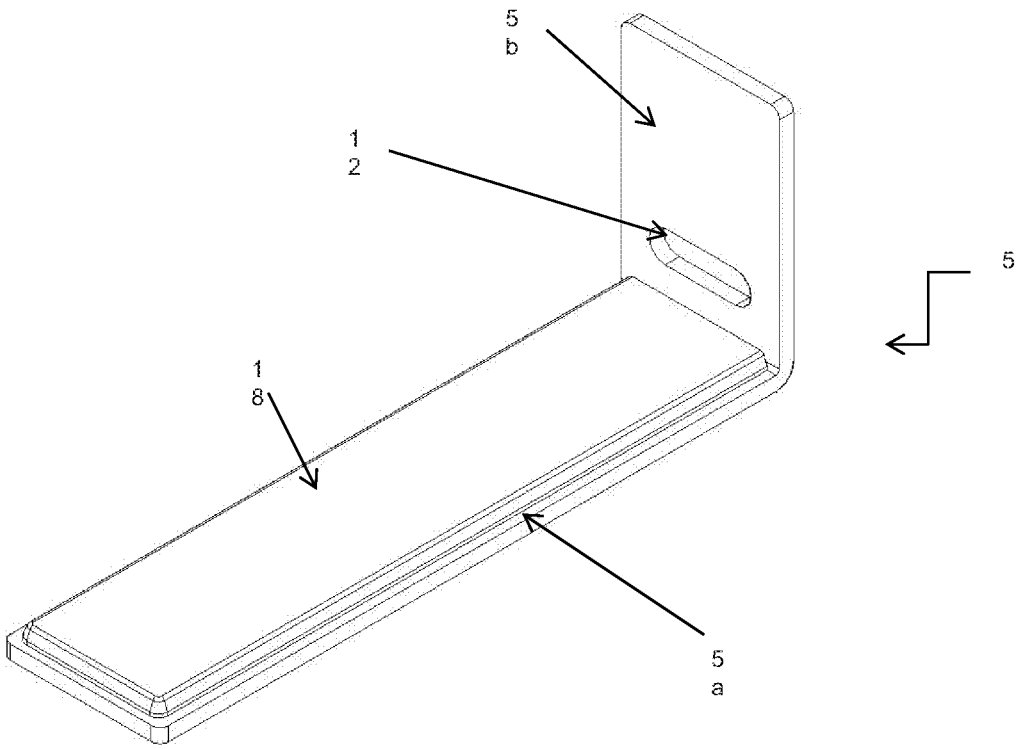
FIG. 3*b* shows the strip of FIG. 3*a* coated with protective material.
Figure 4:
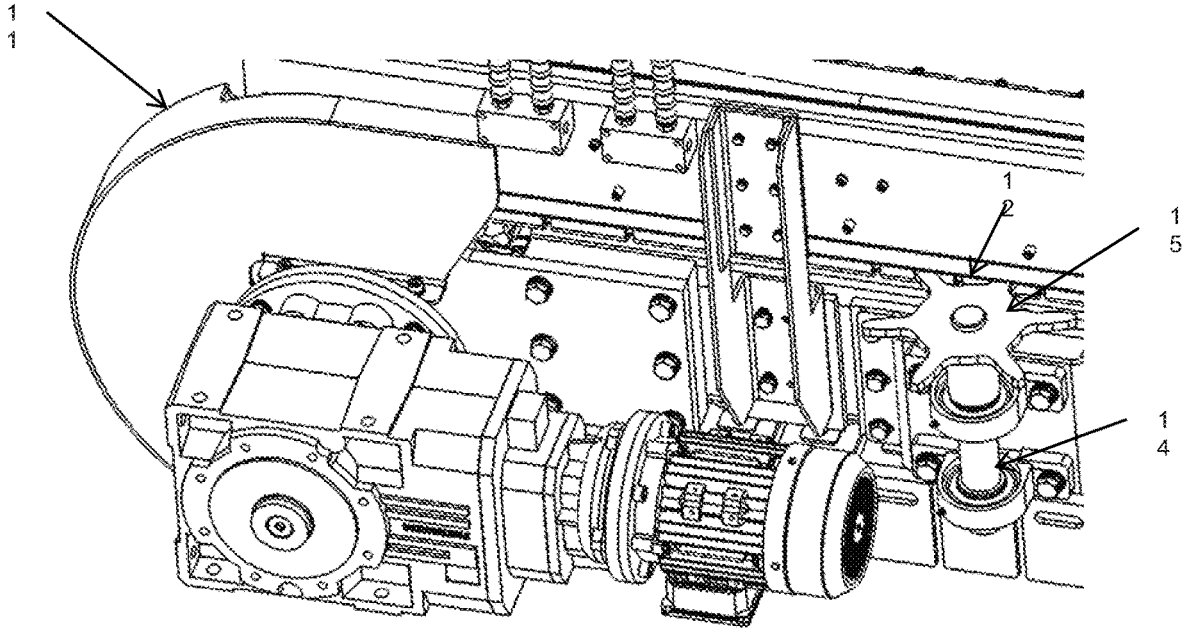
FIG. 4 is an overall view from the back of the sawing machine of FIG. 1.
Figure 5:
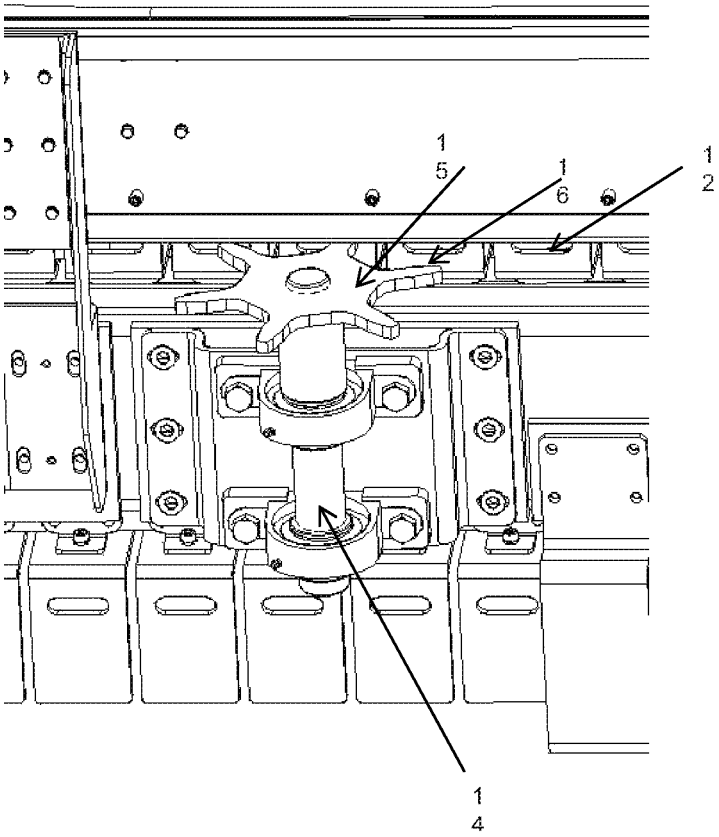
FIG. 5 is a detail of FIG. 4 wherein the crown is shown in engagement with the opening of the strips of the conveyor belt of FIG. 2.

FIG. 3*b* shows another embodiment of the sawing machine 1 of the present invention wherein, in each single strip 5, the first portion 5*a* is coated with a protective material 18, such as rubber. Therefore, each first portion 5*a* of the strip 5 is thus rubberized to be protected from any incisions.

Figure 10:
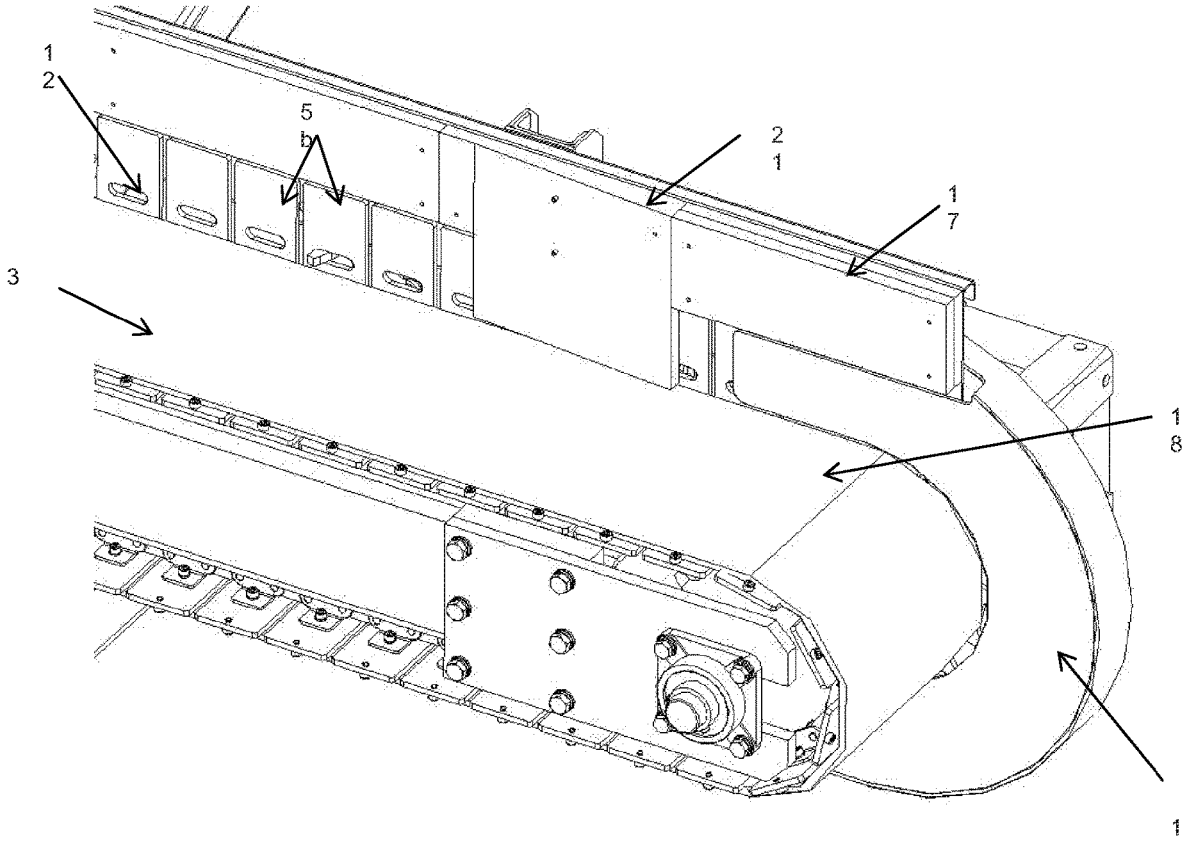
FIG. 10 shows a detail of the embodiment of FIG. 8 wherein a wedge for distancing the stones from the shoulder of the strips is visible.

FIG. 10 shows a detail of the sawing machine 1 of the present invention, wherein there is a wedge-shaped device 21 located next to the crown 15, towards the outlet station 6, to further facilitate the spacing of the stones from the shoulder of the 5*b* portions of the strips 5.

Figure 11:
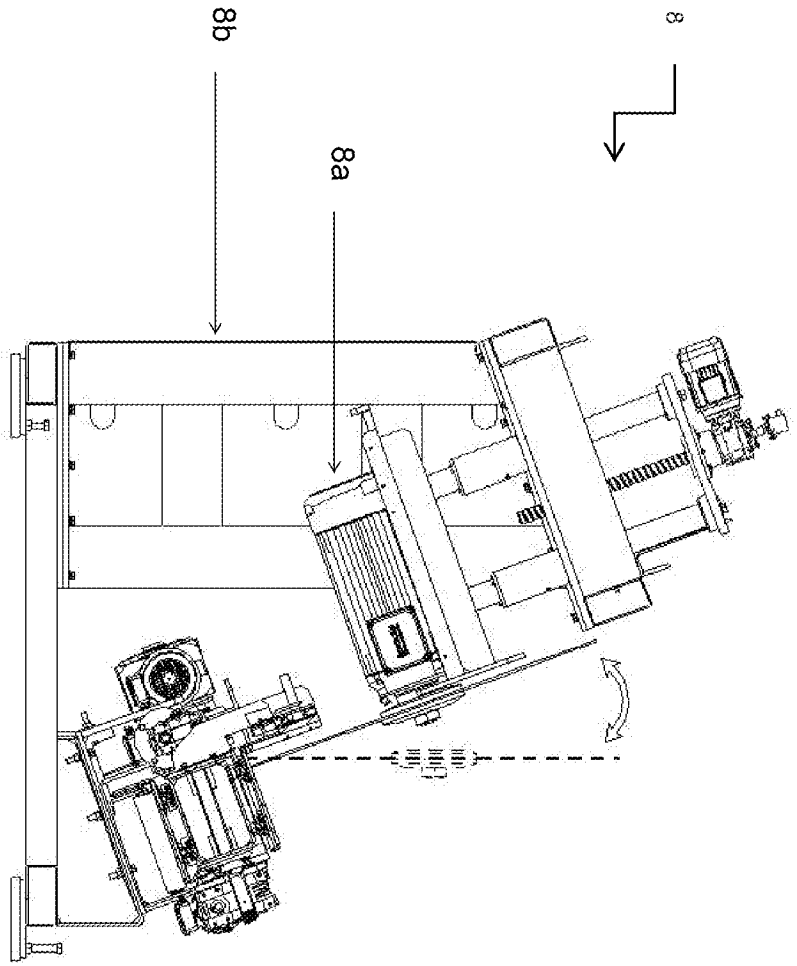
FIG. 11 shows a detail of the cutting device shown in FIG. 1, wherein the cutting blade head inclination is shown.

FIG. 11 shows a detail of the cutting device shown in FIG. 1. In particular, device 8*b* that allows the cutting disk rotation 10 is shown such as to allow the head of the device to assume a tilted position, with respect to the transporting direction of the material to be cut, depending on the user's needs.

Naturally, many modifications and variations of the preferred embodiment described above will be evident to those skilled in the art, still remaining within the scope of the invention.

Therefore, the present invention is not limited to the preferred embodiment described, illustrated only by way of non-limiting example, but is defined by the following claims.

The invention claimed is:

1. An automatic sawing machine (1) for cutting blocks of natural and/or concrete stone material, wherein said machine (1) comprises:

a single motorized conveyor belt (2), which defines a cutting path suitable for receiving in succession said blocks of material to be cut and to transport them from a first inlet station (7) to a second outlet station (6); and a plurality of cutting devices (8) each of them being provided with a motor (8*a*) on whose axis a circular blade (10) is keyed, said cutting devices (8) being constrained to said machine (1) and being arranged above the cutting path defined by the conveyor belt (2) with respect to a vertical direction so that the respective circular blades (10) are inside the cutting path itself;

wherein said single motorized conveyor belt (2) comprises a conveyor plane (3) for transporting the material to be cut and a driving wall (4) that all together contribute to give the single conveyor belt (2) a substantially "L"-shape, and a series of modular strips (5) placed adjacent one to the other, wherein each of said modular strips (5) is a single element having itself an L-shape constituted by a first portion (5*a*) and a second portion (5*b*) placed substantially at 90° with respect to said first portion (5*a*), and wherein the series of said first portions (5*a*) of the strips (5), side by side, constitute said conveyor belt (3) and wherein the series of said second portions (5*b*) of the strips (5), side by side, constitute said driving wall (4); wherein each of said second portions (5*b*) of said strips (5) is provided with a slot (12);

the machine (1) further comprising a support (14) fixed to the machine and a rotatable crown element (15), placed at the top of said support (14), provided of a plurality of protuberances (16) spaced apart from each other so as to allow each of said protuberances (16) to be inserted in turn into one of said slot (12) obtained in one of said second portions (5*b*) of said strips (5), following the movement of the conveyor belt (2).

2. Automatic sawing machine (1) according to claim 1, wherein said single conveyor belt (2) is provided with a cover (11) arranged at said first inlet station (7) and at said second outlet station (6), to protect said second portions (5*b*) of the strips (5), in correspondence with the change of direction of the conveyor belt (2).

3. Automatic sawing machine (1) according to claim 2, wherein said cover (11) is a crankcase cover.

4. Automatic sawing machine (1) according to claim 1, wherein a length of said single conveyor belt (2) can be modified, adding or removing one or more of said single modular strips (5) according to requirements.

5. Automatic sawing machine (1) according to claim 1, which further comprises guides (17) removably fixed to said second portions (5*b*) of said strips (5) to form a support surface raised above said second portions (5*b*) of said strips (5).

6. Automatic sawing machine (1) according to claim 1, wherein the positioning of said circular blades (10) is adjustable according to the required depth of cut.

7. Automatic sawing machine (1) according to claim 1, wherein said conveyor plane (3) of the conveyor belt (2), or each of said first portions (5*a*) of the strips (5) which make up said conveyor plane (3) of the conveyor belt (2), is coated with a mat (18) of protective material.

8. Automatic sawing machine (1) according to claim 7, which further comprises a series of rollers (19) which determine a V-shaped path (20) in order to perform the proper tensioning of said conveyor plane (3) of the conveyor belt (2) coated with said mat (18) in protective material.

9. Automatic sawing machine (1) according to claim 7, wherein said mat (18) of protective material is rubber.

10. Automatic sawing machine (1) according to claim 1, wherein said cutting device (8) is also provided with a device (8*b*) that allows the blade (10) rotation, where the rotation axis is longitudinal with respect to the conveyor belt, so that the cutting head (8) is able to assume a tilted position with respect to the transport direction of the material to be cut.

11. Automatic sawing machine (1) according to claim 1, further comprising circular blades having different diameters keyed on the motor (8*a*) axis.

12. A method, comprising cutting blocks of natural and/or concrete stone material with the automatic sawing machine (1) of claim 1.

* * * * *